United States Patent [19]

Thorwaldson

[11] 4,147,159

[45] Apr. 3, 1979

[54] TEMPERATURE CONTROLLED INSTANTANEOUS WATER HEATING APPARATUS

[76] Inventor: Waldemar S. Thorwaldson, 2332 W. Peck Rd., Whittier, Calif. 90601

[21] Appl. No.: 779,133

[22] Filed: Mar. 18, 1977

[51] Int. Cl.[2] ..... F24H 1/14

[52] U.S. Cl. ..... 126/351; 122/448 A; 236/25 A

[58] Field of Search ..... 122/448 R, 448 S; 236/24, 25 A; 237/19; 126/351

[56] References Cited

U.S. PATENT DOCUMENTS

| | | | |
|---|---|---|---|
| 1,116,915 | 11/1914 | Powers | 236/24 |
| 1,404,249 | 1/1922 | Walker | 236/24 |
| 2,007,714 | 7/1935 | Gauger | 236/24 |
| 3,219,017 | 11/1965 | Thybault | 236/24 |

*Primary Examiner*—John J. Camby
*Assistant Examiner*—Larry I. Schwartz

[57] ABSTRACT

An instantaneous, automatic gas water heater for a hot water system having a cold water supply conduit connected to a plurality of loosely wound small heat exchange tubes which, in turn are connected to a hot water outlet conduit having faucets. The heat exchange tubes are each of smaller internal diameter than the cold and hot water conduits but their total capacity is substanially the same as said conduits. A gas burner is disposed beneath the heat exchange tubes to subject them to the flame of the burner. There is a cover over the heat exchange tubes which confines the heat from the burner about the tubes. The burner is supplied with gas by a gas supply conduit controlled by a normally closed solenoid valve including a gas control valve and a solenoid controlling the gas control valve. There is an electrical system for the solenoid valve and said electrical system includes a diaphragm controlled switch with the diaphragm subjected to water pressure in one of the conduits such as the cold water inlet conduit.

There is also an adjustable temperature control thermostat mechanism subjected to and controlled in accordance with the temperature in the hot water conduit for controlling a second solenoid valve which controls gas to the burner.

9 Claims, 9 Drawing Figures

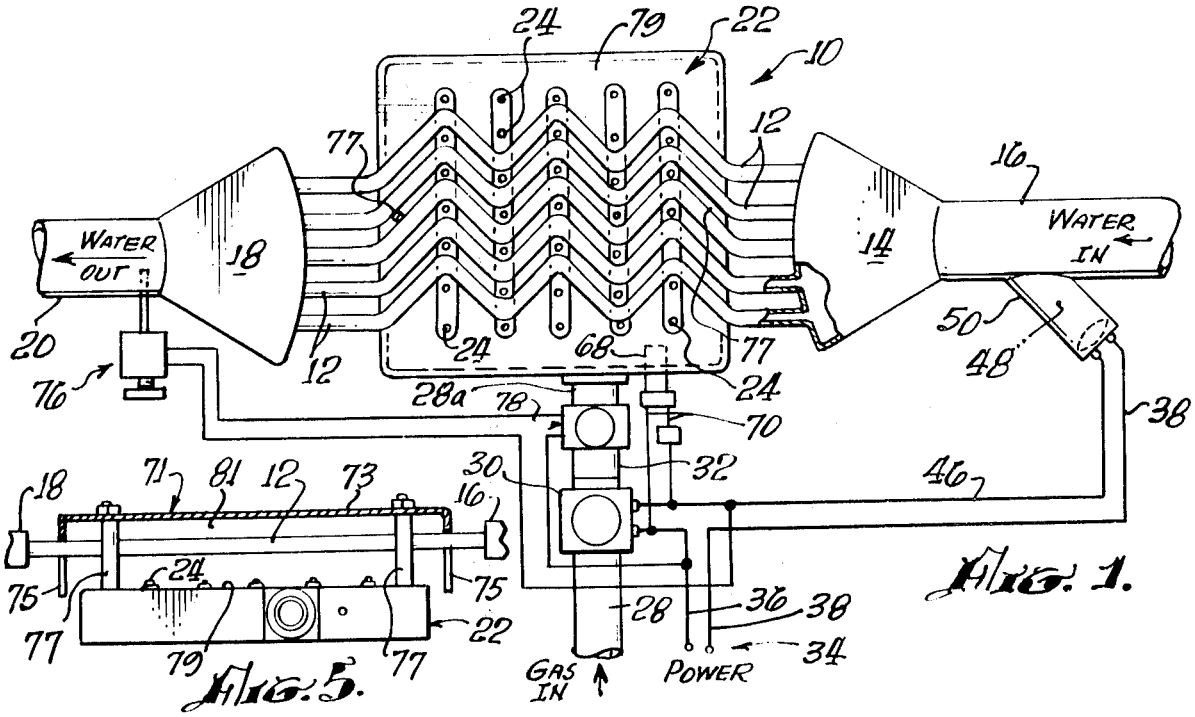
FIG. 1.
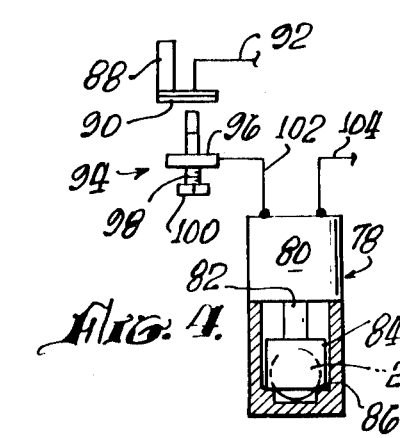
FIG. 4.
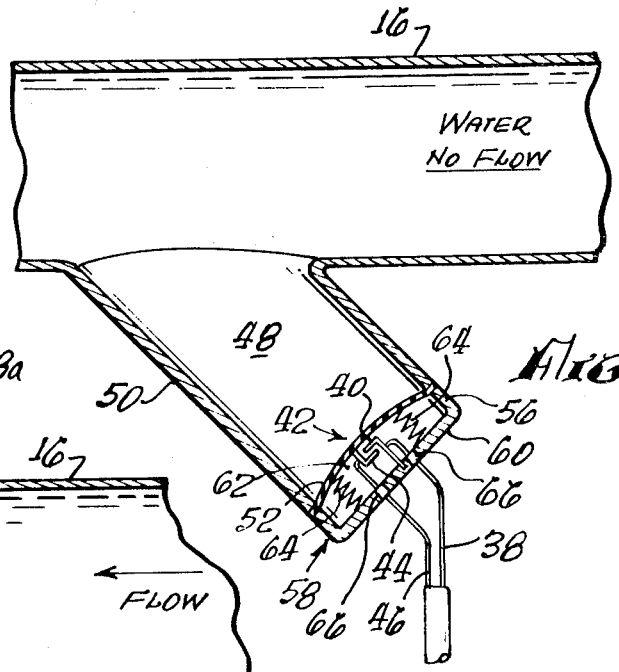
FIG. 2.
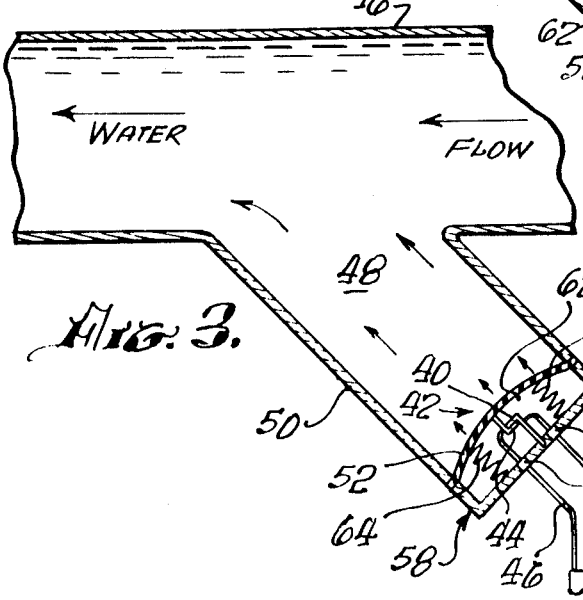
FIG. 3.
FIG. 5.
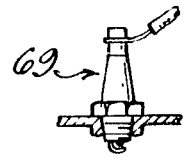
FIG. 6.

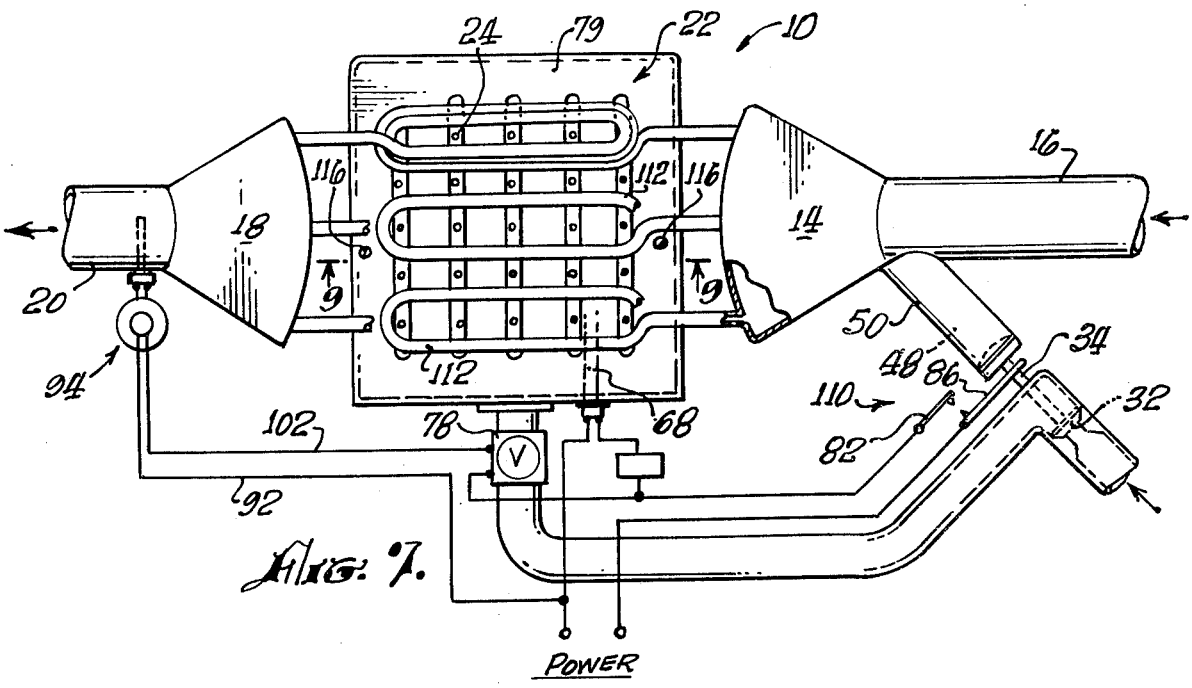
FIG. 7.
FIG. 8.
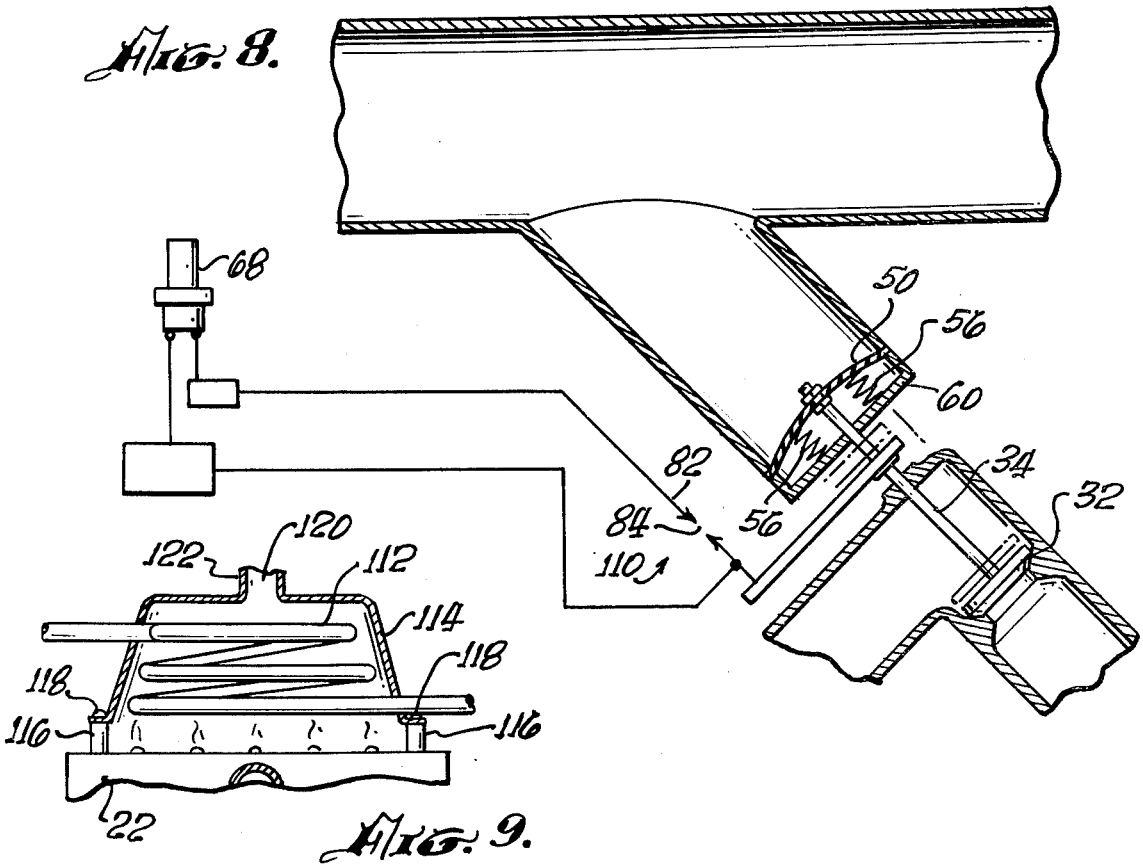
FIG. 9.

TEMPERATURE CONTROLLED INSTANTANEOUS WATER HEATING APPARATUS

BACKGROUND OF THE INVENTION

Field of the Invention

This invention relates generally to gas water-heating apparatuses of the so-called "automatic type" wherein, when a hot water faucet in the service line is turned on, water pressure operates to turn on gas to a gas burner and effect ignition of gas from the burner.

SUMMARY

An instant water heating apparatus which includes a cold water delivery inlet conduit with a flaring free end and a hot water receiving outlet conduit with a flaring inlet and facing the flaring outlet end of the inlet conduit. The flared ends of the inlet and outlet conduits are spaced apart and there are a plurality of smaller diameter tubes connecting said flared ends. The tubes are sinuously arranged in one embodiment and in a generally horizontal plane and in another embodiment the tubes are loosely wound. In both arrangements the total capacity of the tubes is substantially the same as the capacity of the respective cold water conduit and hot water conduit. A gas burner is disposed beneath the tubes for heating water flowing through them. The tubes comprise a heat exchanger and there is a cover on the tubes confining the heat from the burner about said tubes. The burner has a gas inlet conduit adapted to be connected to a source of gas, said gas inlet conduit having a normally closed primary gas control and valve for controlling the flow of gas to the burner. The means for controlling the gas valve comprises a primarily solenoid connected to source of electric power by an electric circuit. There is a switch in said circuit controlling the electric power to the solenoid, said switch being disposed in a control pressure chamber, and said switch, in one embodiment, includes a flexible diaphragm of electrically insulatable material to which a movable switch member is secured. A cap of electrically insulating material is provided for closing the outer end of the pressure chamber and the other switch member, which is a fixed switch member, is secured to the cap. The flexible diaphragm is peripherally mounted in the pressure chamber and is subjected to pressure in the cold water supply conduit. There is also an electric ignition system including an ignition device for the burner also controlled by the electric switch. The igniting device may be either a glow plug or a spark plug. The switch is normally open when there is no water flowing through the conduit to which the control pressure chamber is connected. Upon opening of a faucet there will be a drop of pressure in the conduit due and hence in the control pressure chamber thereby reducing the pressure on the diaphragm allowing it to be moved inwardly by springs so that the switch contacts will engage each other and effect closing of the switch. The solenoid will then be energized to open the gas valve and the ignition device will be energized. A timer is included in the circuit for the ignition device to cut off electrical current to the ignition device after the latter has operated long enough to light the burner. Upon closing of the faucet, the pressure on the diaphragm will increase causing the diaphragm to be urged outwardly against the force of the springs and effect separation of the contact members of the switch, thereby opening the switch. The solenoid will then be de-energized so that the gas valve will be closed. The apparatus will then be ready to operate upon the next opening of a faucet. Means is also provided for controlling or regulating the temperature of the water supplied to the hot water conduit. This means includes a secondary gas valve controlled by a secondary solenoid which has an electric circuit controlled by the switch for supplying electric current through a thermostat mechanism. The secondary gas valve is always partly open even when the thermostat does not call for heat by the burner. Thus when the diaphragm switch is closed, the burner will continue to burn with a very low or minimum flame so that as soon as the thermostat calls for more heat, the burner will immediately respond without ignition by the ignition device. The thermostat is adjustable so as to be set for various water temperatures and when the thermostat calls for heat the secondary solenoid valve is opened wide and the amount of gas supplied is then controlled by the primry solenoid valve.

OBJECTS AND ADVANTAGES

It is the object of the present invention to provide water heating apparatus that saves fuel and is inexpensive to operate.

Another object of the invention is to provide means for concentrating and confining heat from the burner about the heat exchanger.

It is another object of the invention to provide an improved gas water heating apparatus adaptable to automatically provide hot water in the water system when a hot water faucet is opened.

It is still another object of the invention to provide heating apparatus of this character having improved means for controlling the supply of gas to the burner and igniting gas discharged from the burner.

It is a further object of the invention to provide apparatus of this character that has adjustable means for controlling the temperature of the water in the hot water supply conduit.

It is a still further object of the invention to provide apparatus of this character that is simple in construction and operation.

It is another object of the invention to provide apparatus of this character that is efficient in operation.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWING

Referring to the drawings which are for illustrative purposes only:

FIG. 1 is a schematic top plan view of apparatus embodying the present invention;

FIG. 2 is an enlarged schematic sectioned view of the switch mechanism controlling the electric circuit to the solenoid valve, the ignition system, and the temperature control system or mechanism being in the open position;

FIG. 3 is a simular view showing the switch in the closed position;

FIG. 4 is a schematic view, partially in section, of the adjustable temperature control mechanism;

FIG. 5 is a fragmentary horizontal section of the heat exchanger showing the heat concentrating cover therefore;

FIG. 6 is a side elevational view of a spark plug;

FIG. 7 is a view similar to FIG. 1 showing an alternative arrangement, the primary control switch being open;

FIG. 8 is an enlarged schematic view, partly in section, the primary control switch being closed; and FIG. 9 is an enlarged fragmentary end view of the small heat transfer coils.

DESCRIPTION OF THE PREFERRED EMBODIMENTS

Referring more to FIGS. 1 to 5, there is shown a heat exchanger indicated generally at 10 which comprises a plurality of heating tubes 12. The inlet ends of the tubes 12 are connected to a flaring outlet part 14 at the discharge end of a cold water conduit 16 which is connected to any suitable source of water. The opposite ends of the tubes 12 are connected to a flaring hot water inlet part 18 at the inlet end of a hot water supply conduit 20. The parts 14 and 18 face each other and are spaced apart. Tubes 12 have intermediate portions that are sinuously arranged and the internal diameter of tubes 12 is substantially smaller than the internal diameter of conduits 16 and 20 but the total capacity of the tubes 12 is substantially the same as the flow capacity of the conduits 16 and 20.

Beneath the sinuous intermediate portions of tubes 12 is a gas burner 22 having gas discharge openings 24 in the top wall of the burner.

By having the tubes 12 of relatively small flow capacity, the flow of water through the tubes is slowed down or restricted. Also, by having the tubes arranged sinuously, the water in the tube will be subjected to heat from the burner for a longer period of time than if the tubes were straight.

Gas is supplied to the burner from a source of gas by way of a gas conduit 28 connected to a primary solenoid valve 30 which in turn is connected to the burner by a conduit 32. Solenoid valve 30 is normally closed but is opened by energizing the solenoid thereof.

Electric power for the solenoid is provided from any suitable source of power as indicated at 34 and through an electric circuit which includes a wire 36 connected to the solenoid of the primary solenoid valve 30 and a wire 38 which leads to a movable contact 40 of a switch indicated generally at 42. The other contact 44 is a fixed contact which is connected by a wire 46 to the solenoid valve 30.

Switch 42 is disposed in a pressure chamber 48 which is defined by a cylindrical wall 50, although the chamber may be otherwise defined so long as it reflects conduit pressure. While the chamber 48 is shown as connected to the cold water conduit 16, it could be connected to the hot water conduit 20.

Switch 42 comprises a flexible diaphragm 52 which is peripherily clamped between the outer end of wall 50 and a flange 56 of a cap indicated generally at 58, of electrically insulating material. Cap 58 comprises a flange 56 extended from an end wall 60 secured to the outer end of wall 50 by any suitable, well-known means, for example, such as a screw, not shown. Diaphragm 52 and cap 58 define a chamber 62 in which is disposed the switch contacts 40 and 44. Contact 40 is a movable contact and secured by any suitable means to the diaphragm 52 and contact 44 is a fixed contact and is secured to the end wall 60 by any suitable means such as a screw, for example, not shown. Normally, contacts 40 and 44 are separated so that the switch 42 is open. Within chamber 62 are springs 64 yieldingly urging the diaphragm 52 away from end wall 60 of cap 58, the switch contacts 40 and 44 being urged apart in the direction to open the switch. It is to be noted that wires 38 and 46 extend through openings 66 provided therefore in wall 60 of the cap 58 and said wires are connected to their respective contacts.

Means is provided for igniting gas flowing from the openings 24 of the burner 22 and said means comprises an electrical igniting device 68 shown in FIG. 1 as being a glow plug which has wires 70 connected respectively to wires 36 and 46. Alternatively, a spark plug 69, FIG. 5, may be used to ignite a burner 22. When a spark plug is used, the usual electrical elements for creating a spark will be used.

Referring to FIG. 4, a heat concentrating and confining cover, indicated generally at 71, comprises a top 73 with the depending flanges 75 from the edges of the top 73. The cover is supported on screws 77 having their lower ends secured to the top wall 79 of the burner 22. The top 73 and flanges 75 of the cover 71 confine heat from the burner in the space 81 defined by said top and flanges and thereby concentrate the heat about the tubes 12.

When there is no flow of water through conduit 16 the pressure thereof is at its normal value and the pressure in chamber 48 is of the same value. This normal pressure is exerted against diaphragm 54 and causes switch contact member 44 to be separated or spaced from contact 40. Under this condition the solenoid valve 30 is in its normal closed position and the glow plug 68 is inoperative.

Should a hot water faucet be opened, there will be a flow of water in conduit 16 and a drop in pressure of the water in said conduit. A corresponding drop in pressure in chamber 48 will occur allowing the springs 64 to effect closing of switch 42.

Closing of switch 42 will effect energizing the solenoid valve 30 so that a said valve is opened to supply gas to the burner 22. Simultaneously the glow plug 68 will be energized long enough to ignite gas from the burner 22. The timer will then cut off electrical energy to the igniter. The burner 22 will heat the tubes 12 and water passing therethrough as long as switch 42 is closed. Upon closing of the hot water faucet, pressure in suction chamber 48 will increase to normal, which is the normal pressure of water in conduit 16 and thus open switch 42.

There is also means for controlling the temperature of the water in the hot water conduit downstream of the heat exchanger. This means comprises a thermostat mechanism, indicated generally at 76 and a secondary solenoid valve 78. Valve 78 has a solenoid coil 80 with an armature 82 connected to a valve 84 for controlling the flow of gas through the conduit 28*a*. Valve 84 is held slightly opened by stop means such as shoulders 86 when the solenoid 80 is de-energized. Thus, when the primary solenoid valve 30 is opened enough gas is supplied to the burner to keep it burning even when the solenoid 80 is de-energized.

The thermostat includes an element 88 that senses the temperature in the hot water conduit 20 and is connected to a bimetalic element 90 which is connected by a wire 92 to the wire 46 of the switch circuit. An adjustment device indicated generally at 94 has a fixed part 96 with a tapped bore therethrough for a screw 98 having a knob 100 for actuating same. Turning the knob 100 causes the screw to move towards or away from the bimetalic element 90 according to the direction of rotation of said screw. The part 96 is connected by a wire 102 to the solenoid coil 80 and there is a wire 104 connecting the coil 80 with wire 36.

When the switch 42 is closed upon the opening of a hot water faucet, electric current is supplied to the thermostatic mechanism when the screw 98 is contacted by the bimetalic element 90. Should the temperature of the water in the hot water conduit reach the desired value, the bimetalic element will separate from the screw 98 resulting in de-energizing solenoid 80 and causing valve 84 to move in the closing direction and seat on shoulder 86. Gas will still be supplied to the burner and as the water temperature in the hot water conduit drops, the bimetallic element will again contact screw 98 to effect full opening of valve 84 to cause a burner to produce sufficient heat to bring the hot water temperature upwardly to the desired value. With the thermostatic mechanism energizing and de-energizing the solenoid of the secondary value, the water temperature in the hot water conduit will be maintained at the desired value in the usual manner.

Upon closing of the hot water faucet, valve 42 will open, thereby cutting off the supply of electrical current to both the solenoid valve and the igniter.

Referring to FIGS. 7, 8 and 9, there is shown an alternative arrangement. In this arrangement, similar parts are given the same reference numerals as in the arrangement of FIGS. 1 through 6. There is a switch indicated generally at 110, which controls the ignition mechanism 70 and the thermostatically controlled secondary solenoid valve 78 in substantially the same way the switch 42 controls these parts. Switch 110 has a fixed contact 82 and a movable contact 86 connected to stem 34 of the primary gas control valve 32. Switch 110 is normally open but is closed upon opening movement of gas valve 32 which is connected to diaphragm 50.

It is to be noted that the electric circuits for the ignition device, the secondary solenoid gas valve 78, and the thermostatically controlled mechanism 94 are the same as in the arrangement in FIGS. 1 through 5. In operation, when a hot water faucet or tap is opened, there is a pressure drop in the cold water conduit so that springs 56 move the diaphragm 50 inwardly to thereby open the gas valve 32 and close the switch 84. Gas is then supplied to burner 22 and simultaneously the ignition device ignites the gas being discharged from the burner. Normally, the temperature of the water in the hot water conduit 20 would be low enough to close the switch for the secondary solenoid valve 78 and effect full opening thereof. Thereafter, the temperature of the water will be controlled in accordance with the setting of the thermostat. The latter will open and close a switch controlling the electric circuit for the secondary solenoid valve. When the hot water faucet is closed, pressure on the diaphragm 50 will increase and effect closing of valve 32, said pressure in diaphragm 50 overcoming the force of springs 56. Besides closing valve 32, the switch 84 will be opened, thereby de-energizing the electric circuit for the ignition device, the secondary solenoid valve and the temperature control mechanism.

Referring to FIG. 9, an alternative heat exchange coil arrangement is disclosed and there are a plurality of loosely coiled small tubes 112. The total capacity of these tubes is substantially the same as the capacity of the respective cold and hot water conduits.

The cover 114 is provided for the coil tubes 112 to concentrate or retain heat generated by the burner so that the coils 112 will be heated up rapidly. The cover 114 is attached to supports 116 having the lower ends thereof fixed by any suitable means to the top of the burner 22 by means of screws or the like 118. A vent opening 120 is provided and may be connected to atmosphere by any suitable means such as a vent pipe 122 or by any other suitable means.

The invention and its attendant advantages will be understood from the foregoing description, and it will be apparent that various changes may be made in the form, construction and arrangement of the parts of the invention without departing from the spirit or scope thereof or sacrificing its material advantages, the arrangement hereinbefore described being merely by way of example, and I do not wish to be restricted to the specific form shown or uses mentioned except as defined in the accompanying claims.

I claim:

1. Instantaneous automatic water heating apparatus comprising:

a heat exchanger including a water heating tube system comprising a plurality of small tubes;

a cold water supply conduit to said water heating tube system for supplying thereto water to be heated;

a hot water conduit connected to said water heating tube system for reception of heated water therefrom;

said small tubes having substantially the same total flow capacity as the respective cold water supply conduit and the hot water conduit;

a gas burner beneath said tube system for heating water flowing through said tube system;

a gas supply conduit for said burner;

a normally closed primary gas control valve in said gas supply conduit for controlling the supply of gas to said burner;

an ignition device for igniting gas from the burner;

a secondary gas valve for controlling the flow of gas to the burner, said secondary valve being in series with the normally closed primary gas control valve;

thermostatic control means for fully opening said secondary gas control valve upon sensing a temperature and closing said secondary gas control valve to said partly opened position when the temperature sensed is above said predetermined temperature and said primary gas control valve is open;

electric circuits for said igniter device, secondary gas control valve, and the thermostatic means;

and switch means controlled by pressure in one of said water conduits for controlling the circuits to said igniter device, and opening said primary gas control valve and energizing the thermostatic means.

2. The invention defined by claim 1 wherein the secondary gas control valve comprises a solenoid valve.

3. The invention defined by claim 1 wherein the primary valve is a solenoid valve and there is an electric circuit for said solenoid valve.

4. The invention defined by claim 3 wherein the switch means controls the circuit for the primary gas control valve as well as for the circuits for the igniter, the secondary gas control valve, and the thermostatic means.

5. The invention defined by claim 4, including a timer for the ignition device for controlling the length of time the ignition device is energized.

6. The invention defined by claim 1 wherein the primary gas control valve is controlled by pressure in the cold water conduit.

7. The invention defined by claim 6 wherein the switch means is controlled in accordance with movements of the primary valve.

8. The invention defined by claim 1 wherein the tubes are loosely coiled.

9. The invention defined by claim 8 wherein there is a hood over the tubes; and vent means for the hood.

* * * * *